US005197297A

United States Patent [19]

Brendel et al.

[11] Patent Number: 5,197,297

[45] Date of Patent: Mar. 30, 1993

[54] TRANSPORT REFRIGERATION SYSTEM HAVING COMPRESSOR OVER-TEMPERATURE PROTECTION IN ALL OPERATING MODES

[75] Inventors: Thomas E. Brendel, Fayettville; L. Thomas Lane, Manlius, both of N.Y.

[73] Assignee: Carrier Corporation, Syracuse, N.Y.

[21] Appl. No.: 736,887

[22] Filed: Jul. 29, 1991

[51] Int. Cl.[5] ..... F25B 41/00

[52] U.S. Cl. ..... 62/81; 62/197

[58] Field of Search ..... 62/160, 509, 81, 324.6, 62/196.4, 197

[56] References Cited

U.S. PATENT DOCUMENTS 3,219,102 11/1965 Taylor ..... 62/81 X
3,453,838 7/1969 Decker et al. ..... 62/197 X
5,076,067 12/1991 Prenger et al. ..... 62/197

*Primary Examiner*—William E. Wayner

[57] ABSTRACT

A transport refrigeration system of the type which holds a set point temperature by way of heating and cooling cycles. A compressor discharge temperature control circuit is provided which senses the temperature of the hot compressor discharge gas and controls a flow of liquid refrigerant directly into the compressor suction line responsive to the sensed temperature. The receiver of the system is provided with hot gaseous refrigerant to thereby force liquid refrigerant therefrom which supplies the discharge temperature control circuit in all modes of operation.

13 Claims, 2 Drawing Sheets

TRANSPORT REFRIGERATION SYSTEM HAVING COMPRESSOR OVER-TEMPERATURE PROTECTION IN ALL OPERATING MODES

BACKGROUND OF THE INVENTION

1. Field of the Invention

The invention relates in general to transport refrigeration systems of the type which hold a set point temperature by way of heating and cooling cycles, and more specifically to such systems which utilize hot compressor discharge gas for heating.

2. Description of the Prior Art

In the transportation of perishable products, it is recognized that it is necessary to provide refrigeration for the cargo space. It is also well known that it is necessary to periodically provide heat to remove the accumulation of frost or ice from the refrigeration system evaporator. Also, when transporting perishable products through areas having a cold climate, it is necessary to provide heat to the cargo space to prevent excessive cooling or freezing of the perishable products.

A well known method for providing heat for defrost and heating cycles is to divert hot compressor discharge gas from the normal refrigeration circuit, directly to the evaporator to achieve the desired heating. It has been recognized that when such a switch from a cooling cycle to a heating cycle is made, a substantial amount of the refrigerant in the system is trapped in inactive parts of the system and accordingly not available for providing heat.

U.S. Pat. No. 3,219,102 "Method and Apparatus for Deriving Heat From Refrigerant Evaporator" teaches such a heating and defrost system wherein a quantity of the hot compressed gas from the compressor is delivered to the receiver, to thereby pressurize the receiver and thus force liquid refrigerant from the receiver into the remainder of the refrigeration circuit.

Transport refrigeration systems of this type are commonly equipped with a number of safety devices. These safety devices are designed to protect system components from damage caused by unsafe operating conditions. Usually such devices are designed to sense a system parameter and compare the sensed parameter to a predetermined value of the parameter, and, to shut down the unit when such predetermined values are exceeded.

Under adverse operating conditions a transport refrigeration system of the type described in the above identified U.S. Pat. No. 3,219,102 in the hot gas heating mode may experience unacceptably high compressor discharge temperatures. With the use of higher pressure refrigerants such as R-22, which typically run at higher compressor discharge temperatures, such higher temperatures could result in compressor damage or frequent shutdown, both unacceptable.

SUMMARY OF THE INVENTION

It is an object of the present invention to control the compressor discharge temperature in a refrigeration system of the type wherein hot refrigerant gas is circulated to the evaporator for heating.

It is another object of the present invention to inject liquid refrigerant from the receiver into the compressor suction line in a transport refrigeration system of the type wherein hot refrigerant gas is circulated to the evaporator for heating.

These and other objects of the present invention are achieved by a transport refrigeration system of the type which holds a set point temperature via heating and cooling cycles. The system embodies a closed circuit which includes a compressor, a condenser, a receiver, an expansion device, and an evaporator. The system is operated in a heating mode to derive heat from the refrigerant circulated through the system in a manner which includes the steps of blocking the flow of hot compressor discharge gas within the circuit with respect to the condenser while the compressor is operating. The hot compressor discharge gas is then directed through separate paths within the circuit to the evaporator and to the receiver to admit compressed gas into the evaporator and to force liquid refrigerant from the receiver. The flow of liquid refrigerant from the receiver is directed through separate paths within the circuit. The first path from the receiver directs liquid refrigerant to the expansion device to be expanded into the evaporator to provide additional refrigerant in the heating circuit. The second path from the receiver directs liquid refrigerant to the refrigerant line which interconnects the evaporator and the suction port of the compressor. The temperature of the hot compressor discharge gas is sensed. The flow of liquid through the second path is then controlled responsive to the sensed temperature of the compressor discharge gas to maintain the temperature within a predetermined range.

In a preferred embodiment the closed refrigeration circuit includes a compressor, a condenser, a receiver, and an evaporator. A first conduit means is provided for interconnecting the discharge of the compressor with the inlet of the condenser. A second conduit means interconnects the outlet of the condenser with the inlet of the receiver. A first valve means operable between open and closed conditions is located in the second conduit means. A third conduit means interconnects the outlet of the receiver with the inlet of the evaporator while a fourth conduit means interconnects the outlet of the evaporator with the suction port of the compressor. A fifth conduit means interconnects the first conduit means and the third conduit means and is provided with a second valve means operable between open and closed conditions. A sixth conduit means interconnects the fifth conduit means, at a location intermediate the second valve means and the third conduit means with the inlet of the receiver. A check valve means is located in the sixth conduit for allowing flow only in the direction from the fifth conduit to the receiver. A seventh conduit means interconnects the outlet of the receiver with the fourth conduit means. Means are provided for controlling the flow of refrigerant through the seventh conduit means.

BRIEF DESCRIPTION OF THE DRAWINGS

The novel features that are considered characteristic of the invention are set forth with particularity in the appended claims. The invention itself, however, both as to its organization and its method of operation, together with additional objects and advantages thereof, will be best understood from the following description of the preferred embodiment when read in connection with the accompanying drawings wherein:

DESCRIPTION OF THE PREFERRED EMBODIMENT

Figure 1:
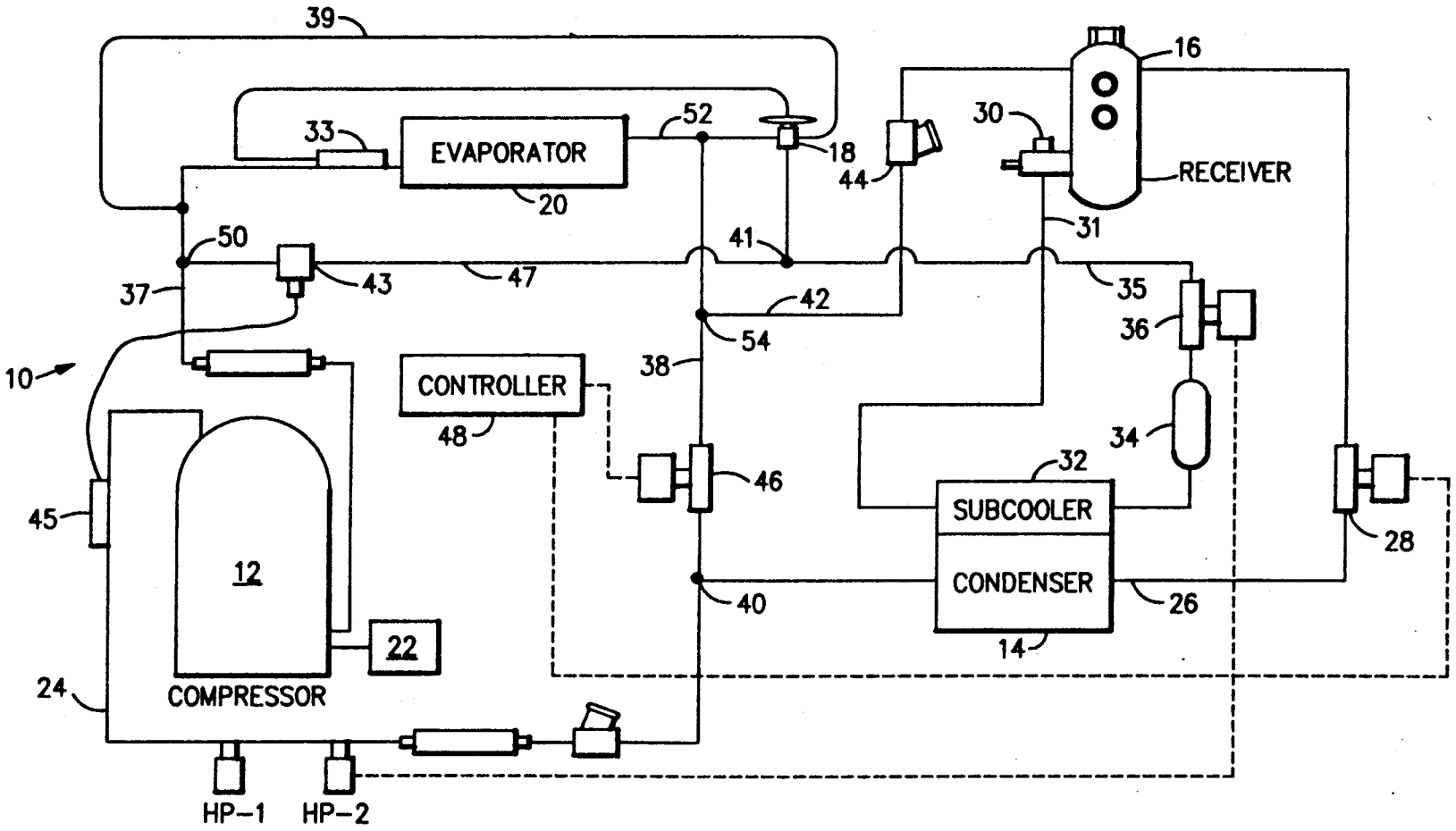
FIG. 1 is a diagrammatical representation of a transport refrigeration system embodying the principles of the present invention.

Referring to the FIG. 1 reference numeral 10 generally designates a compression refrigeration system of the type used in transport refrigeration applications. The system is designed to hold a set point temperature within a cargo space by way of heating and cooling cycles. The system 10 is of the type commonly referred to as a three-valve system for directing hot compressor discharge gas to an evaporator for heating or defrosting. The system 10 is typically mounted on the front wall of a truck or truck trailer. The system includes a reciprocating compressor 12. The compressor is in a refrigeration circuit which serially includes as its main components, the reciprocating compressor 12, an air cooled condenser 14, a receiver 16, an expansion valve 18, and a direct expansion evaporator 20.

The compressor 12 is driven by an internal combustion engine represented schematically by the box bearing reference numeral 22, in a conventional manner. The operation of the refrigeration circuit in the cooling mode of operation is conventional and will be briefly described in connection with the drawing figure before a more detailed description of the system, and the operation of the system, as it applies to the heating and defrosting modes of operation.

In cooling, when the compressor 12 is driven by the engine 22, it compresses the refrigerant in the system, thereby raising its temperature and pressure and forces compressed refrigerant into the condenser 14, via compressor discharge line 24, where it condenses and passes, via refrigerant line 26 and normally open condenser pressure control solenoid valve 28, to the receiver 16.

The receiver 16 stores the additional refrigerant charge necessary for low ambient operation and for the heating and defrost modes. The refrigerant leaves the receiver 16 and flows through a manual receiver shut off valve 30 and, via refrigerant line 31 to a sub-cooler 32. The sub-cooler 32 occupies a portion of the main condensing coils surface and as it flows therethrough the refrigerant gives off further heat to the passing air. From the sub-cooler, the refrigerant flows through a filter dryer 34 which contains an absorbant to keep the refrigerant clean and dry. From the filter dryer 34 the liquid refrigerant flows through the liquid line 35, which includes a normally closed liquid line solenoid valve 36, which starts or stops the flow of liquid refrigerant therethrough, to the main thermostatic expansion valve 18. Liquid refrigerant passes through the expansion valve 18 and is partially flashed and dropped in pressure before reaching the evaporator 20 where the remaining liquid refrigerant evaporates. The gaseous refrigerant is then returned, via refrigerant line 37, to the compressor suction port to complete the cycle. The main expansion valve 18 is controlled by an expansion valve thermal bulb 33 and an external equalizer line 39 in a conventional manner.

Branching off from the liquid line 35, through a T-connection 41 is a quench liquid line 47 having a quench valve 43 located therein. The quench valve 43 is operated by a quench valve bulb 45 positioned on the compressor discharge line 24, which opens and closes the quench valve 43 as required to maintain the compressor discharge temperature within a desired range. More specifically, the quench valve 43 is a constant temperature expansion valve, which controls the delivery of liquid refrigerant into the suction line 37 at a T-connection 50, where it combines with refrigerant leaving the evaporator coil. The quench valve 43 is similar to a common thermal expansion valve, except that it has no downstream pressure input, i.e. equalizer. The valve operates only in response to the temperature of the bulb 45 attached to the compressor discharge line. The operating temperature of the valve is designed such that the discharge temperature will remain significantly below the maximum operating temperature for the particular oil/refrigerant combination being used in the system. The nature of the quench valve is such that it responds slowly to changes in temperature, thus avoiding a "hunting" situation which may occur with the more rapid responding thermal expansion valve.

This arrangement is particularly useful when refrigerants having potentially high discharge temperatures, such as R-22, are used in the system. As will be seen, as the hot gas heating and defrosting operation is described, this arrangement also allows the quench valve 43 to control compressor discharge temperature during these modes of operation.

The components associated with the hot gas heating and defrost system will now be described. Hot gas heating line 38 extends from a T-connection 40 in the compressor discharge line 24. The other leg of the T-connection 40 establishes the fluid communication between the compressor discharge line and the condenser 14. The other end of the hot gas line 38 is in direct fluid flow communication with the refrigerant line 52 to the evaporator 20, downstream from the thermal expansion valve 18. While not shown in the drawing, the hot gas line 38 also serves as a drain pan heater, as is conventional. A branch conduit 42 extends from a T-connection 54 in the hot gas line 38 to establish fluid communication with the receiver 16. Bypass check valve 44 is located in the branch conduit 42 which allows flow only in the direction from the hot gas line 38 to the receiver 16. A hot gas solenoid valve 46 is located in the hot gas line 38 downstream from the T-connection 40.

Automatic control of the refrigeration system is carried out by an electronic controller 48 which preferably includes a micro-processor having a memory storage capability and which is micro-programmable to program the operation of the system components. Of particular interest in connection with the present invention is control of the hot gas solenoid valve 46 and the condenser pressure control solenoid valve 28.

When the controller 48 calls for cooling the hot gas solenoid valve 46 is closed and the condenser pressure control solenoid valve 28 is open thereby allowing the system, with the compressor operating, to function in the cooling mode as described hereinabove. When the controller 48 calls for heating, for either heating of the cargo space, or defrosting the evaporator, the normally closed hot gas solenoid valve 46 will be actuated to an open condition and the condenser pressure control solenoid valve 28 will be actuated to a closed condition. When this occurs the condenser will fill with refrigerant and hot gas from the compressor will pass via the hot gas line 38 directly to the evaporator 20 to provide the desired heat for heating or defrost.

During the heating and defrosting modes of operation, the condenser pressure control solenoid valve 28 is closed thereby blocking the flow of gaseous refrigerant to the receiver 16. The receiver continues to be supplied with hot gaseous refrigerant, however, during these modes of operation by way of the conduit 42 branching off from the hot gas line 38 to supply refrigerant to the receiver through the check valve 44. Accordingly as long as the liquid line solenoid 36 is open, a supply of liquid refrigerant is available to be metered through the expansion valve 18 to allow additional refrigerant to be metered into the hot gas cycle providing additional heating capacity. According to the present invention, the liquid line 35 from the receiver also communicates directly with the quench liquid line 47 thereby assuring a supply of liquid refrigerant to the quench system, as described in detail hereinabove during the heating and defrost modes of operation.

Figure 4:
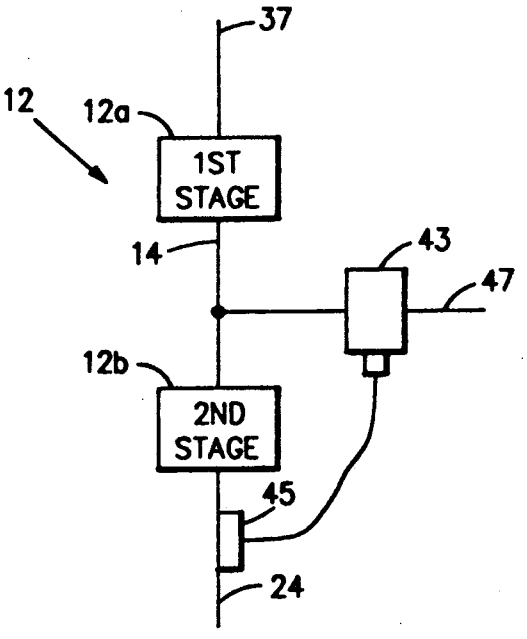
FIG. 4 is a view similar to FIG. 2 showing yet another embodiment.
Figure 3:
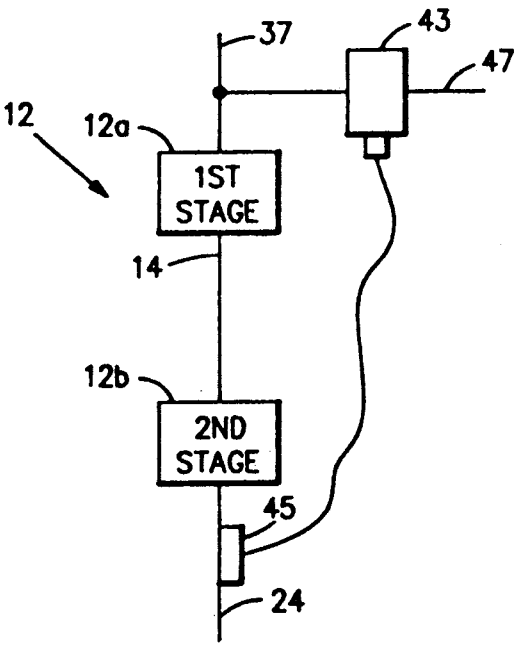
FIG. 3 is a view similar to FIG. 2 showing another embodiment.
Figure 2:
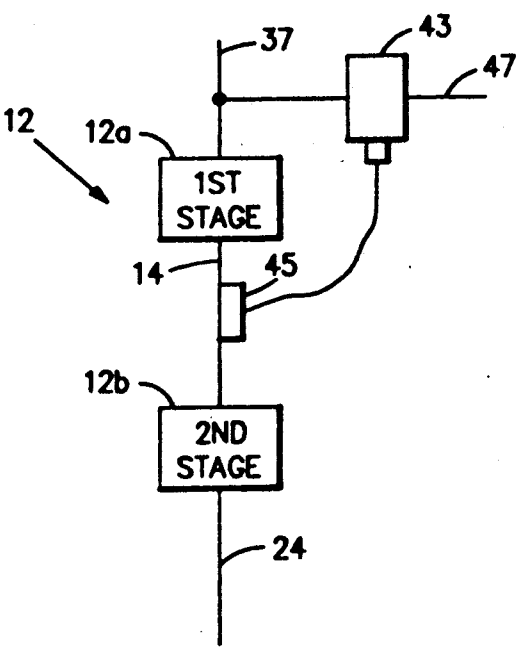
FIG. 2 is a partial diagrammatical representation of one embodiment of a transport refrigeration system, having a two-stage compressor; embodying the principles of the present invention.

Looking now at FIGS. 2, 3 and 4, three embodiments of the invention are shown in connection with a two stage compressor. Each of these embodiments is shown as it relates to the compressor suction line 37 and the compressor discharge line 24 of FIG. 1. The compressor 12 includes a first stage 12*a* and a second stage 12*b* interconnected by an inter-stage conduit 14.

In the embodiments of FIGS. 2 and 3 the quench line 47 communicates with the compressor suction line 37. The FIG. 2 embodiment positions the quench valve control bulb 45 on the inter-stage conduit 14 and thus controls quench responsive to first stage discharge temperature. In the embodiment of FIG. 3 the quench valve control bulb 45 is positioned on the second stage discharge line 24 thus controlling quench responsive to second stage discharge temperature.

In the embodiment of FIG. 4 the quench line 47 communicates with the compressor inter-stage conduit 14. The quench control bulb 45 is located on the second stage discharge line 24 thus controlling quench responsive to second stage discharge temperature.

Accordingly, it will be appreciated that a compressor discharge temperature control arrangement has been provided which includes a liquid injection quench system which operates in all modes of operation of a transport refrigeration system.

This invention may be practiced or embodied in still other ways without departing from the spirit or essential character thereof. The preferred embodiment described herein is therefore illustrative and not restrictive, the scope of the invention being indicated by the appended claims and all variations which come within the meaning of the claims are intended to be embraced therein.

What is claimed is:

1. A transport refrigeration system of the type which holds a set point temperature by way of heating and cooling cycles including a closed refrigerant circuit comprising;

compressor means for compressing gaseous refrigerant delivered thereto, said compressor having a suction port and a discharge port;

condenser means for withdrawing heat from refrigerant passing therethrough, said condenser means having an inlet and outlet;

first conduit means for interconnecting said discharge port of said compressor with said inlet of said condenser;

a receiver having an inlet and an outlet;

second conduit means for interconnecting said outlet of said condenser with said inlet of said receiver;

first valve means, operable between an open and closed condition, disposed in said second conduit means;

an evaporator having an inlet and an outlet;

third conduit means for interconnecting said outlet of said receiver with said inlet of said evaporator;

fourth conduit means for interconnecting said outlet of said evaporator with said suction port of said compressor means;

fifth conduit means for interconnecting said first conduit means and said third conduit means;

second valve means, operable between an open and closed condition, disposed in said fifth conduit;

sixth conduit means for interconnecting said, fifth conduit means, at a location intermediate said second valve means and said third conduit means, with said inlet of said receiver;

check valve means disposed in said sixth conduit for allowing flow only in the direction from said fifth conduit to said receiver;

seventh conduit means for interconnecting said outlet of said receiver with said fourth conduit means; and means for controlling the flow of refrigerant through said seventh conduit.

2. The apparatus of claim 1 wherein said means for controlling the flow of refrigerant through said seventh conduit comprises:

a sensor for sensing the temperature of the hot compressed refrigerant discharged from said compressor through said first conduit; and valve means disposed in said seventh conduit operable responsive to the temperature sensed by said sensor, for controlling the flow of refrigerant therethrough to thereby control the temperature of the compressor discharge gas.

3. The apparatus of claim 2 including, control means for determining when a heating cycle is needed, and, when such need is determined, for operating said first valve means to a closed condition, and, said second valve means to an open condition;

whereby the flow of refrigerant from said compressor is directed to said evaporator via said first and fifth conduit means, and, to said receiver via said first, fifth and sixth conduits; and liquid refrigerant is delivered to said valve means for controlling compressor discharge temperature, via said seventh conduit.

4. The apparatus of claim 1 including expansion means disposed in said third conduit.

5. The apparatus of claim 4 including an economizer heat exchanger operatively disposed in said third conduit means intermediate said receiver and said expansion means.

6. The apparatus of claim 5 including third valve means, operable between an open and closed condition, disposed in said third conduit intermediate said economizer and said expansion device.

7. The apparatus of claim 6 including means for sensing compressor discharge pressure, and, for operating said third valve means to a closed condition when said sensed pressure exceeds a predetermined value.

8. A transport refrigeration system of the type which holds a set point temperature by way of heating and cooling cycles including a closed refrigerant circuit comprising;

compressor means for compressing gaseous refrigerant delivered thereto, said compressor including, first stage compressor means having a suction port and a discharge port, second stage compressor means having a suction port and a discharge port; and means for interconnecting said discharge port of said first stage compressor means and said suction port of said second stage compressor means;

condenser means for withdrawing heat from refrigerant passing therethrough, said condenser means having an inlet and outlet;

first conduit means for interconnecting said discharge port of said second stage compressor means with said inlet of said condenser;

a receiver having an inlet and an outlet;

second conduit means for interconnecting said outlet of said condenser with said inlet of said receiver;

first valve means, operable between an open and closed condition, disposed in said second conduit means;

an evaporator having an inlet and an outlet;

third conduit means for interconnecting said outlet of said receiver with said inlet of said evaporator;

fourth conduit means for interconnecting said outlet of said evaporator with said suction port of said first stage compressor means;

fifth conduit means for interconnecting said first conduit means and said third conduit means;

second valve means, operable between an open and closed condition, disposed in said fifth conduit;

sixth conduit means for interconnecting with fifth conduit means, at a location intermediate said second valve means and said third conduit means, with said inlet of said receiver;

check valve means disposed in said sixth conduit for allowing flow only in the direction from said fifth conduit to said receiver;

seventh conduit means for interconnecting said outlet of said receiver with said compressor means; and means for controlling the flow of refrigerant through said seventh conduit.

9. The apparatus of claim 8 wherein said seventh conduit means interconnects said outlet of said receiver with said inlet of said first stage compressor means.

10. The apparatus of claim 9 wherein said means for controlling the flow of refrigerant through said seventh conduit comprises:

a sensor for sensing the temperature of the hot compressed refrigerant discharged from said first stage compressor means; and valve means, disposed in said seventh conduit, operable responsive to the temperature sensed by said sensor, for controlling the flow of refrigerant therethrough to thereby control the temperature of the compressor discharge gas.

11. The apparatus of claim 9 wherein said means for controlling the flow of refrigerant through said seventh conduit comprises:

a sensor for sensing the temperature of the hot compressed refrigerant discharged from said second stage compressor means; and valve means disposed in said seventh conduit operable responsive to the temperature sensed by said sensor, for controlling the flow of refrigerant therethrough to thereby control the temperature of the compressor discharge gas.

12. The apparatus of claim 8 wherein said seventh conduit means interconnects said outlet of said receiver with said means for interconnecting said discharge port of said first stage compressor means and said suction port of said second stage compressor means.

13. The apparatus of claim 12 wherein said means for controlling the flow of refrigerant through said seventh conduit comprises:

a sensor for sensing the temperature of the hot compressed refrigerant discharged from said second stage compressor means; and valve means disposed in said seventh conduit operable responsive to the temperature sensed by said sensor, for controlling the flow of refrigerant therethrough to thereby control the temperature of the compressor discharge gas.

* * * * *